US009213320B2

(12) United States Patent
Fujisawa

(10) Patent No.: US 9,213,320 B2
(45) Date of Patent: Dec. 15, 2015

(54) ELECTRONIC TIMEPIECE WITH INTERNAL ANTENNA

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 110 days.

(21) Appl. No.: 14/181,935

(22) Filed: Feb. 17, 2014

(65) Prior Publication Data

US 2014/0232603 A1 Aug. 21, 2014

(30) Foreign Application Priority Data

Feb. 21, 2013 (JP) ..... 2013-031710

(51) Int. Cl.

| | |
|---|---|
| ***H01Q 1/24*** | (2006.01) |
| ***G04R 60/08*** | (2013.01) |
| ***G04R 60/12*** | (2013.01) |
| *G04B 47/06* | (2006.01) |
| *G04C 10/02* | (2006.01) |
| *H01Q 1/00* | (2006.01) |
| *G04G 5/00* | (2013.01) |
| *A61J 7/04* | (2006.01) |
| *G04B 37/12* | (2006.01) |

(52) U.S. Cl.

CPC ..... *G04R 60/08* (2013.01); *G04R 60/12* (2013.01); *A61J 7/0481* (2013.01); *G04B 37/127* (2013.01); *G04B 47/065* (2013.01); *G04C 10/02* (2013.01); *G04G 5/002* (2013.01); *H01Q 1/00* (2013.01); *H01Q 1/24* (2013.01)

(58) Field of Classification Search

CPC ..... H01Q 1/24; H01Q 1/00; G04B 47/065; G04B 37/127; A61J 7/0481; G04G 5/002; G04G 10/02

USPC ..... 343/702, 720; 368/14, 10, 205, 47, 278

See application file for complete search history.

(56) References Cited

U.S. PATENT DOCUMENTS

| | | | | |
|---|---|---|---|---|
| 7,286,098 | B2 | 10/2007 | Ogino et al. | |
| 2014/0085153 | A1 * | 3/2014 | Nagahama | 343/720 |

FOREIGN PATENT DOCUMENTS

| | | | |
|---|---|---|---|
| JP | 2005-102183 | A | 4/2005 |
| JP | 3982918 | B2 | 9/2007 |
| JP | 2009-168656 | A | 7/2009 |
| JP | 2012-075090 | A | 4/2012 |
| JP | 2012-235224 | A | 11/2012 |

* cited by examiner

*Primary Examiner* — Joseph Lauture

(74) *Attorney, Agent, or Firm* — Harness, Dickey & Pierce, P.L.C.

(57) ABSTRACT

An electronic timepiece has a tubular outside case of which at least part is a conductive material, a transparent crystal, a dial housed in the outside case, an annular antenna body disposed around the dial, a feed part that feeds the antenna body, and a dial ring made of a non-conductive material covering the antenna body. The antenna body includes an annular dielectric base, and an arc-shaped fed element feed by the feed part, an annular parasitic element disposed between the dial ring and crystal, and receives circularly polarized waves.

9 Claims, 6 Drawing Sheets

ELECTRONIC TIMEPIECE WITH INTERNAL ANTENNA

BACKGROUND

1. Technical Field

The present invention relates to an electronic timepiece with an internal antenna.

2. Related Art

Electronic timepieces that receive signals frompositioning information satellites such as GPS (Global Positioning System) satellites to display time accurately are known from the literature. Such electronic timepieces have a ring-shaped antenna for receiving radio signals frompositioning information satellites. See, for example, JP-A-2009-168656 or Japan Patent 3982918.

A movement for displaying analog time, a case that houses the movement, a cover member that covers the face side of the movement, a ground plane disposed between the cover member and the movement, and a ring-shaped antenna disposed on the outside of the ground plane between the ground plane and the cover member are disclosed in JP-A-2009-168656, thereby assuring both a feeling of good quality and good antenna performance at the same time.

A ring-shaped antenna comprising a C-shaped loop element that is disposed inside the case of a wristwatch and receives circularly polarized waves is disclosed in Japan Patent 3982918. The circumferential length of the antenna is approximately equal to one wavelength of the RF signal after wavelength shortening by the dielectric. The technology taught in Japan Patent 3982918 enables reducing the size of the antenna by means of wavelength shortening so that a loop antenna for receiving GPS satellite signals (1 wavelength=19 cm) can be fit inside the outside case member of a wristwatch.

Technology using a parasitic element not connected to a circuit has also been used to efficiently receive circularly polarized waves from GPS satellites. More specifically, the parasitic element is disposed near the antenna element that is fed, and impedance is improved by electromagnetically coupling the parasitic element to the antenna element and lowering the resonance frequency. GPS signal reception performance can thus be improved by adjusting the resonance frequency to the GPS satellite signal, for example.

However, when such a parasitic element is used with a ring-shaped antenna as disclosed in JP-A-2009-168656 and Japan Patent 3982918, the parasitic element will be located near the case because the antenna element is disposed near the case, which is made of a conductive material. As a result, the parasitic element will be affected by the conductive case members, the antenna performance of the parasitic element cannot be assured, and signal reception sensitivity drops.

SUMMARY

An electronic timepiece with an internal antenna according to the present invention improves antenna performance and improves signal reception performance in a ring antenna that receives circularly polarized waves by disposing a parasitic element at a position separated a specific distance from an outside case of which at least part is made of a conductive material and reducing the effect of the outside case on the parasitic element.

An electronic timepiece with internal antenna according to the invention includes: a tubular outside case of which at least part is made from a conductive material; a cover member that covers one of two openings in the case; a time display unit housed inside the case; an annular antenna body disposed around the time display unit; a feed part that feeds the antenna body; and a non-conductive ring member that covers the antenna. The antenna body includes an annular dielectric base and an arc-shaped fed element that is fed by the feed part, and an annular parasitic element is disposed between the ring member and the cover member and receives circularly polarized waves.

In the electronic timepiece with internal antenna according to the invention, the antenna body functions as a loop antenna. More specifically, the antenna body functions as a C-shaped loop antenna having a notch in the ring, and the feed point that is the beginning and end of the loop antenna is located at the notch in the C shape. By adjusting the circumferential length from the beginning to the end of the loop antenna to approximately 1 wavelength of the received signal, reception performance approximately equal to a configuration having two half-wavelength dipole antennae disposed in parallel on opposite sides of the feed point can be maintained.

In addition, because the electronic timepiece with internal antenna uses a parasitic element, the resonance frequency can be lowered and the impedance characteristic improved by electromagnetically coupling the parasitic element with the antenna body. As a result, GPS signal reception performance can be improved by matching the resonance frequency to the GPS satellite signal, for example.

Furthermore, because the parasitic element is between the ring member and cover member in this electronic timepiece with internal antenna, the parasitic element can be disposed to a position separated a specific distance from the outside case member, and the effect of conductive members in the outside case on the parasitic element can be reduced. As a result, antenna performance can be improved in the electronic timepiece with internal antenna, and signal reception sensitivity can be improved.

The invention can thus provide an electronic timepiece with internal antenna that improves antenna performance and improves signal reception sensitivity even when used to receive satellite signals from GPS satellites because the invention can reduce the effect of the outside case on the parasitic element.

Materials other than metal, such as ceramic and plastic, can be used as a "non-conductive material."

The concept of a "time display unit" includes the dial in a timepiece, and displaying time on a dial includes analog displays using hands and digital displays using a LCD device, for example. Examples of such hands include a hour hand, minute hand, and second hand.

"Tubular" as used herein includes rotating bodies such as cylinders.

Transparent materials that are optically transparent, such as glass and plastic, can be used as the cover member.

"Annular" includes circles and approximate rectangles, open circles such as a C with a part missing, and closed circles such as O and ring-shaped configurations.

A metal or other conductive member can be used as the parasitic element, which could be a ring-shaped metal plate of stainless steel, for example, shaped like copper wire instead of flat, or a meandering configuration comprising arc-shaped members of different radii connected together to increase the circumferential length.

Preferably, the antenna body and the parasitic element of the electronic timepiece with internal antenna are mutually superimposed in plan view. By superimposing the parasitic element and antenna body in plan view, the shortest distance between the fed element and the parasitic element can be achieved, electromagnetically coupling the fed element and the parasitic element can be strengthened, and the parasitic element can be efficiently driven through the antenna body.

Further preferably, the parasitic element is disposed on the cover member side of the ring member. By disposing the parasitic element on the cover member side of the ring member, the parasitic element can be disposed to a position separated from the outside case while maintaining a gap between the fed element and the parasitic element, and the effect of the outside case including a conductive member can be reduced. As a result, the antenna performance of an electronic timepiece with internal antenna can be improved, and signal reception sensitivity can be improved.

Yet further preferably in an electronic timepiece with internal antenna according to another aspect of the invention, the parasitic element is affixed to an annular member, and the annular member is disposed to the cover member side of the ring member. Because the parasitic element is affixed to an annular member instead of to the ring member in this configuration, the reception characteristics of the antenna body can be optimized by simply replacing the parasitic element affixed to the annular member when the shape of the outside case changes and the tuning frequency of the antenna body shifts due to the effect of the outside case in conjunction with a change in the design of the electronic timepiece. A common antenna body can thus be used in electronic timepieces of different designs by thus using a separate parasitic element.

Yet further preferably in an electronic timepiece with internal antenna according to another aspect of the invention, the fed element is disposed on the cover member side of the antenna body. Because this configuration can minimize the distance between the fed element and the parasitic element, electromagnetic coupling between the fed element and the parasitic element can be strengthened, and the parasitic element can be efficiently driven through the antenna body.

Yet further preferably in an electronic timepiece with internal antenna according to the invention, an annular blind member is affixed to the cover member of the parasitic element so that the parasitic element cannot be seen from the outside. By affixing an annular blind to the cover member side of the parasitic element, the parasitic element cannot be seen, and the appearance of the electronic timepiece is not adversely affected.

Yet further preferably, the electronic timepiece with internal antenna according to another aspect of the invention also has a back cover made from a conductive material, the back cover is electrically connected to the outside case, and the back cover and the outside case functioning as the ground plane of the antenna body. Because the back cover and the body of the outside case, which have a large volume and area, function as the ground plane in this electronic timepiece, the ground potential is stable and good reception performance can be assured in the antenna.

Yet further preferably, the outside case of an electronic timepiece with internal antenna according to the invention has a bezel that is made from a non-conductive material and fastens the cover member. Because the bezel is made from a non-conductive material, the bezel does not function as an electromagnetic shield to the antenna body.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that the size and scale of parts shown in the figures differ from the actual size and scale for convenience. Furthermore, the following examples are specific preferred embodiments of the invention and describe technically desirable limitations, and the scope of the invention is not limited thereby unless such limitation is specifically stated below.

Embodiment 1

Figure 1:
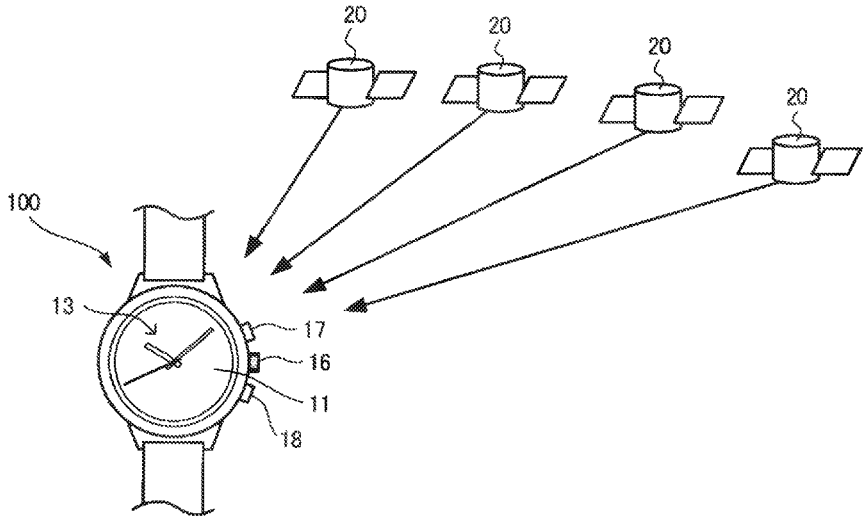
FIG. 1 is an overview of a GPS system including an electronic timepiece with internal antenna 100 according to a first embodiment of the invention.

FIG. 1 shows the basic concept of a GPS system that includes an electronic timepiece with internal antenna 100 (below, electronic timepiece 100) according to a preferred embodiment of the invention. The electronic timepiece 100 is a wristwatch that receives signals (radio signals) from GPS satellites 20 and adjusts the time based thereon, and displays the time on the surface (side) (referred to below as the "face") on the opposite side as the surface (referred to below as the "back") that contacts the wrist.

A GPS satellite 20 is an example of a positioning information satellite that orbits the Earth on a specific orbit, and transmits a navigationmessage superimposed on a 1.57542 GHz RF signal (L1 signal). The 1.57542 GHz signal carrying a superimposed navigation message is referred to herein as simply a "satellite signal." These satellite signals are right-handed circularly polarized waves.

The invention is described below using the GPS system as an example of a satellite positioning system, but the invention is not so limited. More particularly, the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The electronic timepiece 100 may therefore be a wristwatch that receives radio waves (radio signals) frompositioning information satellites other than GPS satellites 20, and adjusts the internal time based thereon.

There are currently approximately 31 GPS satellites 20 in the constellation. Only 4 of the 31 satellites are shown in FIG. 1.

Each GPS satellite 20 superimposes a unique pattern called a C/A code (Coarse/Acquisition Code), which is a 1023-chip (1 ms) pseudorandom noise code unique to a specific GPS satellite 20, on the satellite signal. This code is used to identify which GPS satellite 20 transmitted a particular satellite signal. Each chip is a value of +1 or −1, and the C/A code appears to be a random pattern. The C/A code superimposed on the satellite signal can therefore be detected by correlating the satellite signal that is actually received with the known pattern of each C/A code.

Each GPS satellite 20 carries an atomic clock, and the highly precise time information ("GPS time information" below) kept by the atomic clock is included in the satellite signal transmitted by the GPS satellite 20. The time difference of the atomic clock onboard each GPS satellite 20 is measured by the ground control segment, and a time correction parameter for correcting this time difference is also included in the satellite signal. The electronic timepiece 100 receives a satellite signal transmitted from one GPS satellite 20, and adjusts the internal time to the correct time using the GPS time information and time correction parameter contained in the received signal.

Orbit information indicating the position of the GPS satellite 20 on its orbit is contained in the satellite signal. The electronic timepiece 100 can calculate its own position using the GPS time information and orbit information. This position calculation assumes that there is some degree of error in the internal time kept by the electronic timepiece 100. More specifically, in addition to the parameters x, y, z for determining the three-dimensional position of the electronic timepiece 100, this time error is also an unknown. The electronic timepiece 100 therefore generally receives satellite signals from four or more GPS satellites, and calculates its own position using the GPS time information and orbit information contained in each of the received signals.

Figure 2:
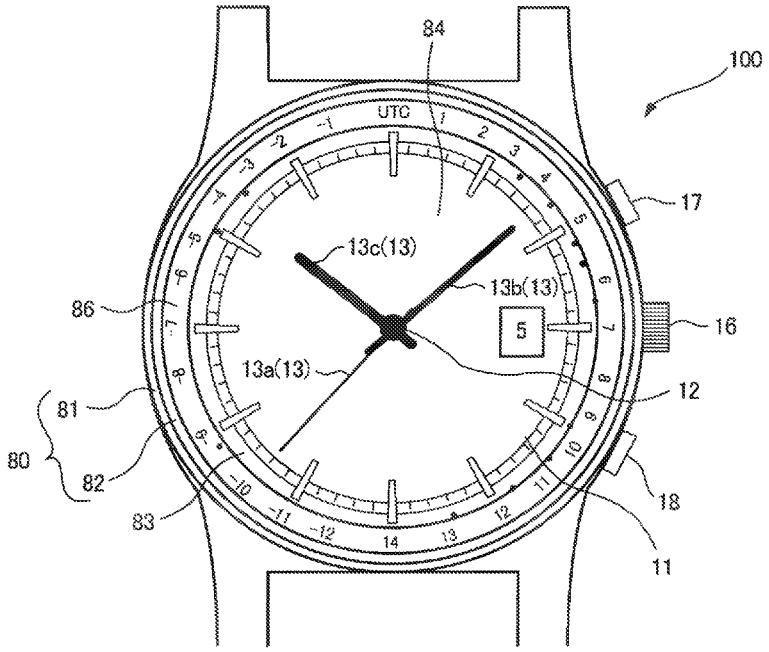
FIG. 2 is a plan view of the electronic timepiece 100.

FIG. 2 is a plan view of the electronic timepiece 100.

As shown in FIG. 2, the electronic timepiece 100 has a tubular outside case 80. The case 80 includes a cylindrical case body 81 made of metal or other conductive material, and a bezel 82 made of ceramic (such as zirconia or alumina) or other non-conductive material. The bezel 82 is fit into the case body 81.

An annular dial ring 83 is disposed inside the bezel 82, and a round dial 11 is disposed inside the dial ring 83. Bar-shaped markers for indicating the time (hour) are disposed every 30 degrees around the dial ring 83, and such markers are not disposed to the dial 11. The information shown on the dial ring 83 and the information shown on the dial 11 are different from each other, and are not limited to the information shown in the figure.

Hands 13 (13*a* to 13*c*) that turn on a center pivot 12 and indicate the current time are disposed above the dial 11. The dial 11 may also be referred to as the time display unit below. Further described below, the case has two openings, one each on the face and the back cover sides. The opening on the face side of the case 80 is covered by a glass crystal 84 held by the bezel 82, and the dial 11 and hands 13 (13*a* to 13*c*) can be seen through the crystal 84. Note that a different type of transparent cover, such as plastic, could be used instead of a glass crystal 84.

By manually operating the crown 16 and pushers 17, 18 shown in FIG. 1 and FIG. 2, the electronic timepiece 100 can be set to a mode (time information acquisition mode) that receives satellite signals from at least one GPS satellite 20 and adjusts the internal time, and a mode (positioning information acquisition mode) that receives signals from plural GPS satellites 20, calculates the current position, and adjusts the time difference of the internal time. The electronic timepiece 100 can also execute the time information acquisition mode and positioning information acquisition mode regularly (automatically).

Figure 3A:
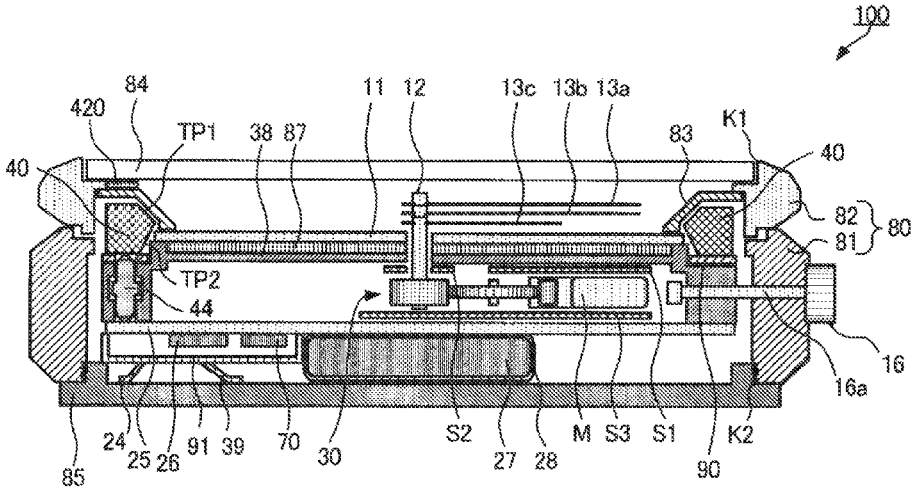
FIG. 3A is a partial section view showing the internal structure of the electronic timepiece 100.
Figure 3B:
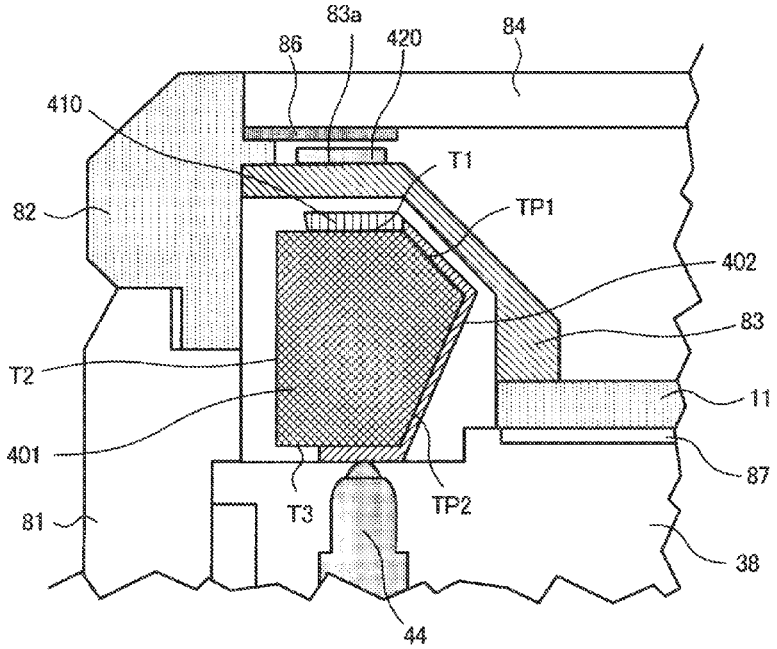
FIG. 3B is a enlarged section view showing part of FIG. 3A.
Figure 4:
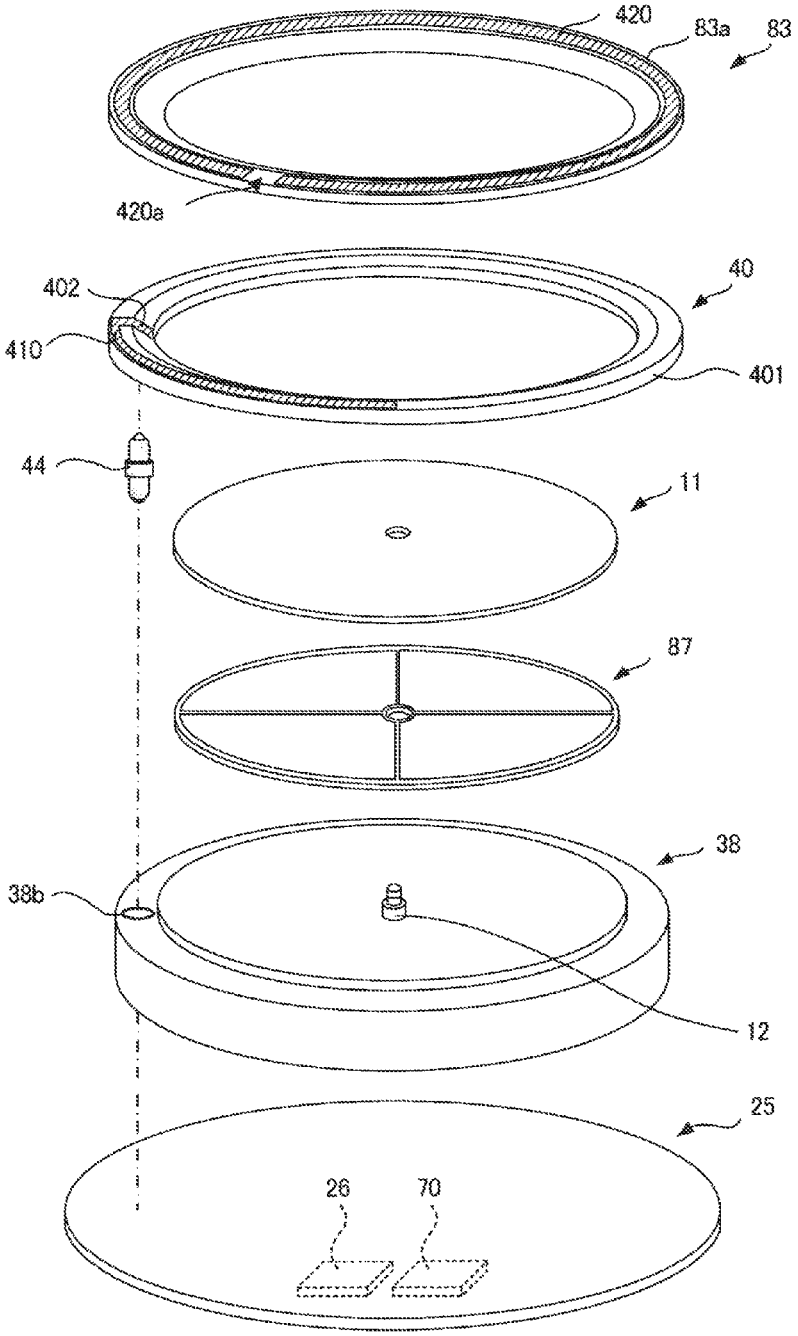
FIG. 4 is an exploded view of part of the electronic timepiece 100.

FIG. 3A is a section view showing part of the internal structure of the electronic timepiece 100, and FIG. 3B is an enlarged section view of part of the internal structure. FIG. 4 is an exploded oblique view showing parts of the electronic timepiece 100. As shown in FIG. 3A, FIG. 3B, and FIG. 4, the annular bezel 82 made of ceramic is fit to the face side of the outside case 80, and an annular dial ring 83 made of plastic is attached along the inside circumference of the bezel 82.

The case 80 has a top opening K1 on the face side where the time is displayed by the time display unit, and a bottom opening K2 on the opposite side as the face. The top opening K1 is covered by the round crystal 84, and the bottom opening K2 is covered by a back cover 85 made of metal such as SUS (stainless steel) or Ti (titanium). The case body 81 and back cover 85 screw together, for example. The crystal 84 is held in the bezel 82 by an intervening packing ring (not shown in the figure), for example.

The ring-shaped dial ring 83 is disposed along the inside circumference of the bezel 82 below (on the back cover side of) the crystal 84 as shown in FIG. 4. The dielectric constant □r of the material used for the dial ring 83 is adjusted to approximately 5-20 by mixing a dielectric material that can be used in high frequency applications, such as titanium oxide, with resin. A main plate 38 made of plastic or other non-conductive material is disposed inside the inside circumference of the case body 81 below the dial ring 83.

A donut-shaped storage space is formed by the main plate 38, the dial ring 83, and inside surface of the case 80. The annular antenna body 40 is housed in this space. The antenna body 40 is thus disposed around the dial 11 (between the dial and the case when seen perpendicularly to the dial 11). Part of the antenna body 40 is therefore housed inside the inside circumference of the bezel 82, and is covered on top by the dial ring 83.

An annular ground plane 90 made of metal is disposed in this space between the antenna body 40 and the main plate 38. The ground plane 90 is electrically connected to the back cover 85 through a conductive spring 24, and is electrically connected to the case body 81 because the back cover 85 is affixed to the case body 81. Note that this function of the ground plane 90 could be rendered by a shield 91, and the ground plane 90 omitted.

The antenna body 40 includes an annular base 401 made of a dielectric material, and an antenna element 410 formed on the base 401.

The base 401 is adjusted to a dielectric constant □r of approximately 5-20 by mixing a dielectric material that can be used in high frequency applications, such as titanium oxide, with resin. As shown in FIG. 3B, the base 401 has a pentagonal section including a top T1, outside face T2, bottom T3, slope TP1, and second slope TP2. As shown in this figure, the fed element 410 is formed on the top T1, which is the surface on the crystal 84 side of the antenna body 40.

The fed element 410 is made of metal or other conductive material, and is formed in a particular pattern on the top T1 of the base 401 by a plating or silver paste printing process. A feed part 402 made of metal or other conductive material is also disposed to the antenna body 40. More specifically, as shown in FIG. 3B, the feed part 402 is disposed to the slope TP1, second slope TP2, and bottom T3 of the base 401. The fed element 410 is electrically connected to a feed pin 44 through the feed part 402. A specific potential is thereby supplied to the fed element 410 of the antenna body 40.

When seen in section view, that is, from the direction parallel to the dial 11, an annular parasitic element 420 is disposed above the fed element 410 between the dial ring 83 and the crystal 84. An annular blind 86 is disposed to the face side of the parasitic element 420 so that the parasitic element 420 cannot be seen from the outside.

The parasitic element 420 is made from a metal such as silver or other conductive material, and as shown in FIG. 3B is disposed on the top 83*a* on the crystal 84 side of the dial ring 83 and superimposed on the fed element 410 in plan view. More specifically, when seen from the direction perpendicular to the dial 11 (in plan view), the parasitic element 420 and fed element 410 are stacked together. The parasitic element 420 is formed in a specific pattern on the top 83*a* by silver paste printing, plating, or vapor deposition, for example. By forming the parasitic element 420 in unison with the dial ring, positioning precision can be increased and deviation in the antenna frequency can be reduced.

The blind 86 is a sheet of plastic or other non-conductive material, and is bonded to the back 84*a* of the crystal 84. Numbers indicating the time difference in different countries are presented on the surface of the back cover 85 in this embodiment of the invention.

In this embodiment, the fed element 410 and parasitic element 420 are electromagnetically coupled and function as an antenna element that converts electromagnetic waves to current. Note that the fed element 410 and parasitic element 420 are disposed with a constant gap (approximately 5 mm or less) therebetween because they are electromagnetically coupled and coupling is weakened if the gap therebetween is too large.

As shown in FIG. 4, parasitic element 420 has a notch 420*a*, and thus forms a C-shape with a notch in the ring. The parasitic element 420 has an electrical length that resonates to 1 wavelength of the radio waves (satellite signals) received from a positioning information satellite.

As shown in FIG. 4, the fed element 410 is formed in an arc, and by appropriately setting the length of the fed element 410, impedance can be matched with the circuit electrically connected to the antenna body 40. In this embodiment, the fed element 410 has an electrical length that resonates at 0.25 wavelength.

The frequency of signals from GPS satellites 20 is 1.575 GHz, and the length of one wave is approximately 19 cm. Because an electrical length of approximately 1.0 to 1.2 wavelength is required to receive circularly polarized waves, a loop antenna of approximately 19-24 cm is required to receive signals from GPS satellites 20. Putting a loop antenna with such an electrical length inside a wristwatch would result in a very large wristwatch.

This embodiment of the invention therefore forms the antenna body 40 with a base 401 made from a dielectric with a dielectric constant □r of 5-20. The dial ring 83 on which the parasitic element 420 is formed is also made from a dielectric with a dielectric constant □r of 5-20. When a dielectric with a dielectric constant □r is used, the wavelength shortening rate of the dielectric is $(\square r)^{-1/2}$. More specifically, the wavelength of the signals received by the antenna can be shortened $(\square r)^{-1/2}$ times by using a dielectric with a dielectric constant □r. Because the base 401 and dial ring 83 in this embodiment are dielectrics with a dielectric constant □r, the electrical length of the antenna body 40 can be shortened compared with a configuration not having such a dielectric, and the overall size of the device having the antenna body 40 can be reduced.

By setting the position of the notch 420*a* in the parasitic element 420 separated 45 degrees or 225 degrees from the position of the feed part 402, radiation from standing waves produced in the parasitic element 420 and radiation from the fed element 410 can be combined, and circularly polarized waves can be efficiently emitted.

As shown in FIG. 3A, an optically transparent dial 11, a solar panel 87 for solar power generation, a center pivot 12 passing through the dial 11, solar panel 87, and main plate 38, and plural hands 13 (second hand 13*a*, minute hand 13*b*, hour hand 13*c*) that move around the center pivot 12 and display the current time, are disposed inside the inside circumference of the antenna body 40.

The solar panel 87 is a round disc having plural solar cells (photovoltaic devices) that convert light energy to electrical energy (power) connected in series. The solar panel 87 is disposed inside the inside circumference of the antenna body 40 and between the main plate 38 and dial 11. A center hole through which the center pivot 12 passes is formed in the center of the solar panel 87.

The center pivot 12 extends in the direction between the face and back along the center axis of the case 80. The dial 11 is round and made of plastic or other optically transparent, non-conductive material. As shown in FIG. 3A, the dial 11 is disposed between the crystal 84 and main plate 38. A hole through which the center pivot 12 passes is formed in the center of the dial 11. The hands 13 are disposed between the crystal 84 and the dial 11 inside the inside circumference of the antenna body 40.

A drive mechanism (drive unit) 30 that causes the center pivot 12 to turn and drives the plural hands 13 is disposed below (on the back cover side of) the main plate 38 as shown in FIG. 3A. The drive mechanism 30 includes a stepper motor M and wheel train, and drives the hands 13 by the stepper motor M causing the center pivot 12 to turn through the wheel train. More specifically, the drive mechanism 30 causes the center pivot 12 to turn so that the hour hand 13*c* turns one revolution in 12 hours, the minute hand 13*b* turns one revolution in 60 minutes, and the secondhand 13*a* turns one revolution in 60 seconds.

The electronic timepiece 100 has a circuit board 25 inside the case 80. The circuit board 25 is made of resin or other material including a dielectric, and is disposed below the drive mechanism 30 (that is, between the drive mechanism 30 and the back cover 85). A circuit block including a GPS reception unit (radio receiver) 26 and control unit 70 is disposed on the bottom (on the surface facing the back of the wristwatch) of the circuit board 25. The GPS reception unit 26 is a single-chip IC module, for example, and includes analog and digital circuits. The control unit 70 sends control signals to the GPS reception unit 26 and controls the reception operation of the GPS reception unit 26, and controls operation of the drive mechanism 30.

A feed pin 44 made of metal or other conductive material is disposed to the top of the circuit board 25. The feed pin 44 is a metal pin-shaped connector with an internal spring, rises vertically from the top of the circuit board 25 and passes through the through-hole 38*b* formed in the main plate 38, and connects the circuit board 25 and antenna body 40. The feed part 402 of the antenna body 40 is therefore electrically connected to the circuit board 25 (more precisely, to wiring disposed to the circuit board 25) through the feed pin 44, and a specific potential from the circuit board 25 is supplied to the fed element 410 and parasitic element 420.

The circuit block including the GPS reception unit 26 and control unit 70 is covered by a shield 91 made of a conductive material. The shield 91 is electrically connected to the ground plane 90 through a circuit support 39, the back cover 85, and the case body 81. The ground potential of the circuit block is supplied to the shield 91. More specifically, the shield 91, back cover 85, case body 81, and ground plane 90 are held at the ground potential of the circuit block, and function as a ground plane.

Magnetic screens S1 and S2 are disposed between the drive mechanism 30 and the main plate 38, and another magnetic screen S3 is disposed between the drive mechanism 30 and circuit board 25. Magnetic screens S1 and S2 are referred to below as a first magnetic screen, and magnetic screen S3 as a second magnetic screen. Magnetic screens S1 to S3 are made of a conductive material with high permeability, such as pure iron.

If there is a speaker or other object that produces a strong magnetic field on the outside of the electronic timepiece 100, the magnetic field can cause the stepper motors M to operate incorrectly. Of the parts of the electronic timepiece 100, metal in the case body 81 and back cover 85 produces a magnetic field when magnetized. Circuit blocks on the circuit board 25 can also produce a magnetic field.

By covering the stepper motors M with magnetic screens S1 to S3 made of a high permeability material, this embodiment of the invention magnetically shields the drive mechanism 30 and prevents the stepper motor M from operating incorrectly due to the magnetic fields described above.

A lithium ion battery or other cylindrically shaped storage battery 27, and a battery compartment 28 for holding the storage battery 27, are also disposed inside the case 80 of the electronic timepiece 100. The storage battery 27 is charged by the power produced by the solar panel 87. The battery compartment 28 for holding the storage battery 27 is below the circuit board 25 (that is, between the circuit board 25 and back cover 85).

The crown 16 and pushers 17, 18 (FIG. 2) are disposed on the outside of the case 80. Movement of the crown 16 resulting from the user of the electronic timepiece 100 operating the crown 16 is transferred through the stem 16*a* passing through the case 80 to the drive mechanism 30. Movement of the pusher 17 (or 18) produced by the user of the electronic timepiece 100 pressing the pusher 17 (or 18) is transferred to a switch not shown through the corresponding button stem passing through the case 80. These switches convert pressure from the pusher 17 (or pusher 18) to an electrical signal, and output the signal to the control unit 70.

Figure 5:
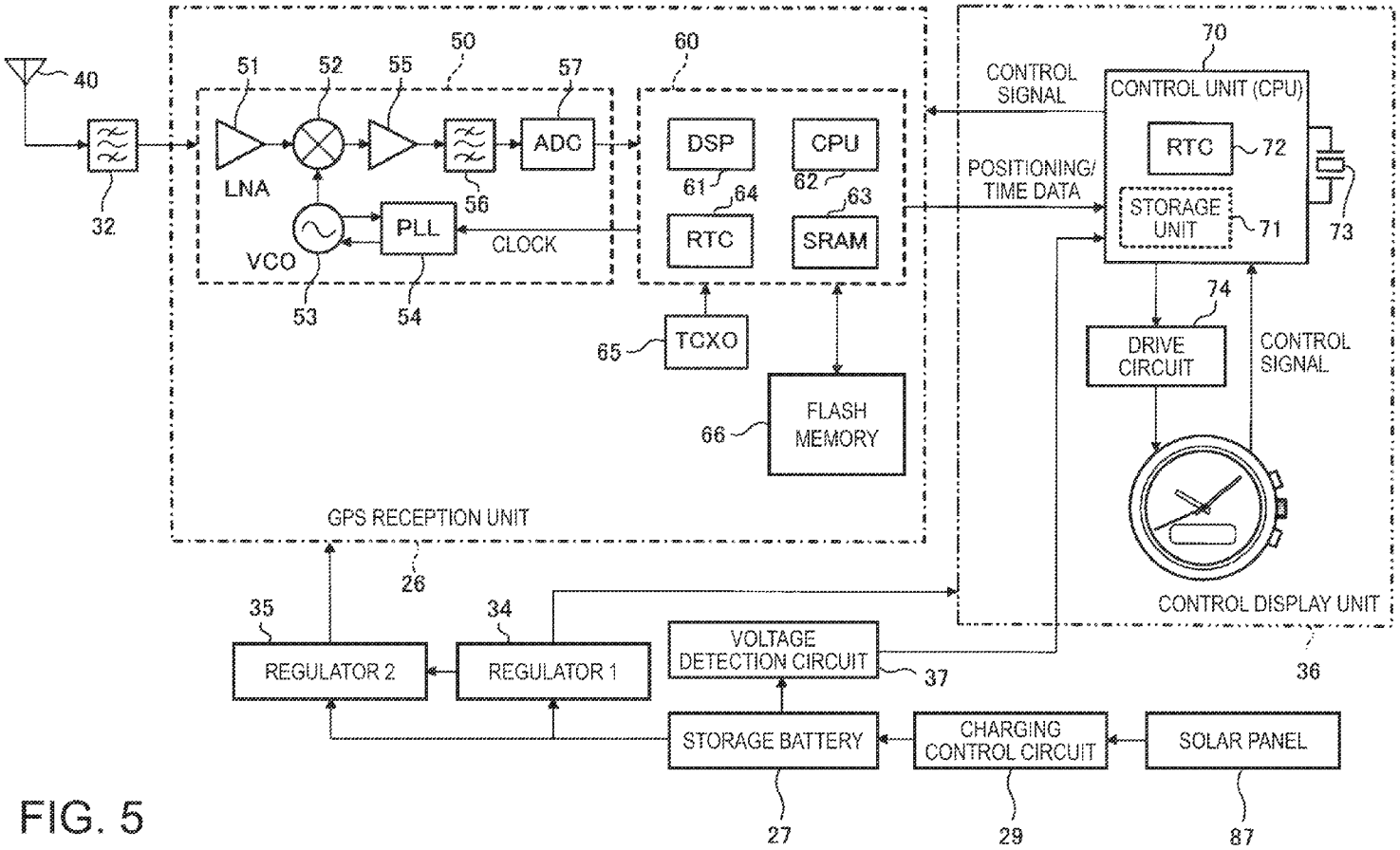
FIG. 5 is a block diagram showing the circuit configuration of the electronic timepiece 100.

FIG. 5 is a block diagram showing the circuit configuration of the electronic timepiece 100. As shown in FIG. 5, the electronic timepiece 100 includes a GPS reception unit 26 and a control display unit 36. The GPS reception unit 26 executes processes related to receiving satellite signals, locking onto GPS satellites 20, generating positioning information, and generating time correction information, for example. The control display unit 36 executes processes including keeping the internal time and adjusting the internal time.

A solar panel 87 charges the storage battery 27 through the charging control circuit 29.

The electronic timepiece 100 has regulators 34 and 35, and the storage battery 27 supplies drive power through a regulator 34 to the control display unit 36, and supplies drive power through another regulator 35 to the GPS reception unit 26.

The electronic timepiece 100 also has a voltage detection circuit 37 that detects the voltage of the storage battery 27.

Regulator 35 could be split into a regulator 35-1 (not shown) that supplies drive power to the RF unit 50 (described below), and a regulator 35-2 (not shown) that supplies drive power to a baseband unit 60 (described below). In this implementation, regulator 35-1 could be disposed in the RF unit 50.

The electronic timepiece 100 also has the antenna body 40, a balun 10, and a SAW (surface acoustic wave) filter 32. As described with reference to FIG. 1, the antenna body 40 receives satellite signals from plural GPS satellites 20. However, because the antenna body 40 also receives noise in addition to the satellite signals, the SAW filter 32 extracts the satellite signals from the signals received by the antenna body 40. In other words, the SAW filter 32 functions as a bandpass filter that passes signals in the 1.5 GHz waveband.

The GPS reception unit 26 includes the RF (radio frequency) unit 50 and baseband unit 60. As described below, the GPS reception unit 26 executes a process that extracts satellite information including GPS time information and orbit information contained in the navigation message from the 1.5 GHz satellite signal extracted by the SAW filter 32.

The RF unit 50 includes a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

The satellite signal passed by the SAW filter 32 is amplified by the LNA 51. The satellite signal amplified by the LNA 51 is mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal, and synchronizes the output clock signal of the VCO 53 to the reference clock signal. As a result, the VCO 53 can output a stable clock signal with the frequency precision of the reference clock signal. Note that several megahertz, for example, can be selected as the intermediate frequency.

The signal from the mixer 52 is amplified by the IF amplifier 55. However, mixing by the mixer 52 also produces a high frequency component of several GHz in addition to the IF signal. The IF amplifier 55 therefore amplifies both the IF signal and the high frequency component of several GHz. The IF filter 56 therefore passes the IF signal and removes the high frequency component of several GHz (more accurately, attenuates the signal to a specific level or less). The IF signal passed by the IF filter 56 is converted to a digital signal by the A/D converter 57.

The baseband unit 60 includes, for example, a DSP (digital signal processor) 61, CPU (central processing unit) 62, SRAM (static random access memory) 63, and RTC (real-time clock) 64. A TCXO (temperature compensated crystal oscillator) 65 and flash memory 66 are also connected to the baseband unit 60.

The temperature compensated crystal oscillator (TCXO) 65 generates a reference clock signal of a substantially constant frequency regardless of temperature. Time zone information, for example, is stored in flash memory 66. The time zone information defines the time difference between the current location and UTC based on specific coordinates (such as latitude and longitude).

The baseband unit 60 executes a process that demodulates the baseband signal from the digital signal (IF signal) output from the A/D converter 57 of the RF unit 50 when set to the time information acquisition mode or the positioning information acquisition mode.

In addition, when the time information acquisition mode or the positioning information acquisition mode is set, the baseband unit 60 executes a process that generates a local code of the same pattern as each C/A code, and correlates the local codes to the C/A code contained in the baseband signal, in the satellite search step. The baseband unit 60 adjusts the timing when the local code is generated to find the peak correlation to each local code, and when the correlation equals or exceeds a threshold value, confirms synchronization with the GPS satellite 20 matching the local code (that is, confirms locking onto a GPS satellite 20). Note that the GPS system uses a CDMA (Code Division Multiple Access) method whereby all GPS satellites 20 transmit satellite signals on the same frequency using different C/A codes. The GPS satellites 20 that can be locked onto can therefore be found by identifying the C/A code contained in the received satellite signal.

To acquire the satellite information from the satellite signal of the GPS satellite 20 that was locked onto in the time information acquisition mode or the positioning information acquisition mode, the baseband unit 60 executes a process that mixes the baseband signal with the local code of the same pattern as the C/A code of the GPS satellite 20 that was locked.

The navigation message containing the satellite information of the GPS satellite 20 that was locked onto is demodulated in the mixed signal. The baseband unit 60 then executes a process to detect the TLM word (preamble data) of each subframe in the navigation message, and acquire (such as store in SRAM 63) satellite information such as the orbit information and GPS time information contained in each subframe. The GPS time information as used here is the week number (WN) and Z count, but the Z count data alone could be acquired if the week number was previously acquired.

The baseband unit 60 generates the time adjustment information required to correct the internal time based on the satellite information.

In the time information acquisition mode, the baseband unit 60 more specifically calculates the time based on the GPS time information, and generates time correction information. The time correction information in the time information acquisition mode may be the GPS time information, or information about the time difference between the GPS time and internal time.

However, in the positioning information acquisition mode, the baseband unit 60 more specifically calculates the position based on the GPS time information and orbit information, and acquires the location information (more specifically calculates the latitude and longitude of the electronic timepiece 100 when the satellite signals were received).

Next, the baseband unit 60 references the time difference (time zone) information stored in flash memory 66, and acquires the time difference at the coordinates (such as latitude and longitude) of the electronic timepiece 100 determined from the positioning information. The baseband unit 60 thus generates satellite time data (GPS time information) and time zone (time difference) data as the time correction information. The time correction information used in the positioning information acquisition mode may thus be the GPS time information and time zone information as described above, but the time difference between the internal time and the GPS time could be used instead of the GPS time information.

Note that the baseband unit 60 can generate the time correction information using the GPS time information from one GPS satellite 20, or the baseband unit 60 can generate the time correction information from satellite information from a plurality of GPS satellites 20.

Operation of the baseband unit 60 is synchronized to the reference clock signal output by the TCXO 65. The RTC 64 generates the timing for satellite signal processing, and counts up at the reference clock signal output from the TCXO 65. The RTC 64 in the baseband unit 60 operates only when receiving the satellite information of the GPS satellite 20, and stores the GPS time information.

The control display unit 36 includes a control unit 70, crystal oscillator 73, and drive circuit 74.

The control unit 70 includes a storage unit 71 and a RTC (real-time clock) 72, and controls various operations. The control unit 70 can be rendered with a CPU, for example. The control unit 70 outputs control signals to the GPS reception unit 26, and controls reception by the GPS reception unit 26. The control unit 70 also controls operation of regulators 34, 35 based on output from the voltage detection circuit 37. The control unit 70 also controls movement of the hands through the drive circuit 74.

Internal time information is stored in the storage unit 71. The RTC 72 operates continuously, keeps the internal time for displaying the time, and generates the internal time information. The internal time information is the information of the time kept internally by the electronic timepiece 100, and is updated based on the reference clock signal generated by the crystal oscillator 73. The internal time can therefore be updated and the hands moved even when power is not supplied to the GPS reception unit 26.

When the time information acquisition mode is set, the control unit 70 controls operation of the GPS reception unit 26, corrects the internal time based on the GPS time, and stores the time in the storage unit 71. More specifically, the internal time is corrected to UTC (Coordinated Universal Time) by adding a UTC offset to the acquired GPS time.

When the positioning information acquisition mode is set, the control unit 70 controls operation of the GPS reception unit 26, corrects the internal time based on the satellite time data (GPS time) and time zone (time difference) data, and stores the time in the storage unit 71.

As described above, because a parasitic element 420 is used in the electronic timepiece 100, when current flows to the fed element 410, current is induced, the parasitic element 420 is electromagnetically coupled to the antenna body 40, the resonance frequency drops, and impedance can be improved. As a result, by matching the resonance frequency to the satellite signals from the GPS satellites, GPS signal reception performance can be improved.

More particularly, by disposing the parasitic element 420 between the dial ring 83 and crystal 84, the parasitic element 420 is positioned at a distance from the case body 81. More specifically, the fed element 410 is on the top T1 of the base 401, and the parasitic element 420 is on the top 83*a* of the dial ring 83 and superimposed on the fed element 410 in plan view. As a result, a gap for electromagnetically coupling the fed element 410 and parasitic element 420 can be assured while the parasitic element 420 can be located at a distance from the case body 81 and the effect of the case body 81 made of a conductive material can be reduced. As a result, the antenna performance of the electronic timepiece 100 can be improved, and signal reception performance can be improved. Note that an improvement of 1.5 dB in antenna gain toward the zenith as a result of disposing the parasitic element above the dial ring has been confirmed.

In addition, because there are many places where adjustment is possible in an antenna configuration including a C-shaped parasitic element 420 and an arc-shaped fed element 410, including the location of the notch (angle) and element length, antenna elements can be more easily adjusted to achieve optimum antenna performance matching the case of the electronic timepiece than when the elements are in a single unit.

Furthermore, because an annular blind 86 is formed on the crystal 84 side of the parasitic element 420 so that the parasitic element 420 cannot be seen, the parasitic element 420 cannot be seen from the outside, and the parasitic element 420 can be prevented from detracting from the appearance of the electronic timepiece.

Of the two openings to the case 80, a metal back cover 85 covers the opening on the opposite side as the display side of the dial 11, the back cover 85 is electrically connected to the case body 81, and the back cover 85 and case body 81 having a large volume and area function as a ground plane for the antenna body 40. By thus using members located below the antenna body 40 as the ground plane of the antenna, reflection from the back cover 85 increases radiation in the direction normal to the face of the timepiece, and extremely high reception performance is achieved.

Furthermore, because the case body 81 and back cover 85 are metal, the effect of the wrist on which the timepiece is worn on impedance matching is minimal, there is substantially no difference in antenna characteristics when the timepiece is worn and not worn, and stable reception can be assured. More specifically, using plastic for the case body 81 and back cover 85 detracts from an appearance of high quality and is undesirable in terms of antenna performance because antenna impedance is different when the timepiece is worn and not worn due to the effect of the wrist (body), and performance is therefore different when the timepiece is worn and not worn.

Furthermore, because the timepiece has a bezel 82 made from a non-conductive material that engages the case body 81 and secures the crystal 84, the bezel 82 can be prevented from functioning as an electromagnetic shield for the antenna body 40 and high reception performance can be achieved.

Embodiment 2

Figure 6:
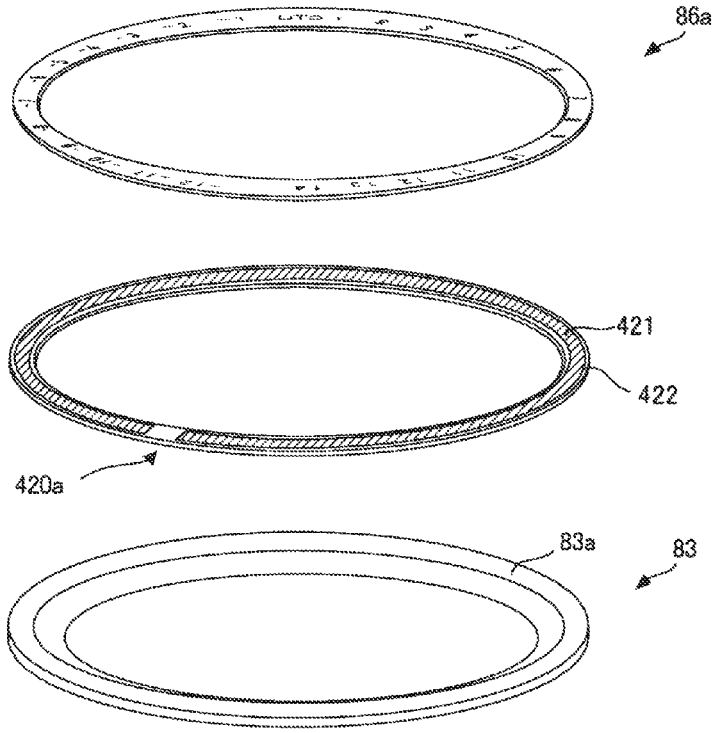
FIG. 6 is an exploded view of part of electronic timepiece with internal antenna 200 (electronic timepiece 200) according to a second embodiment of the invention.
Figure 7:
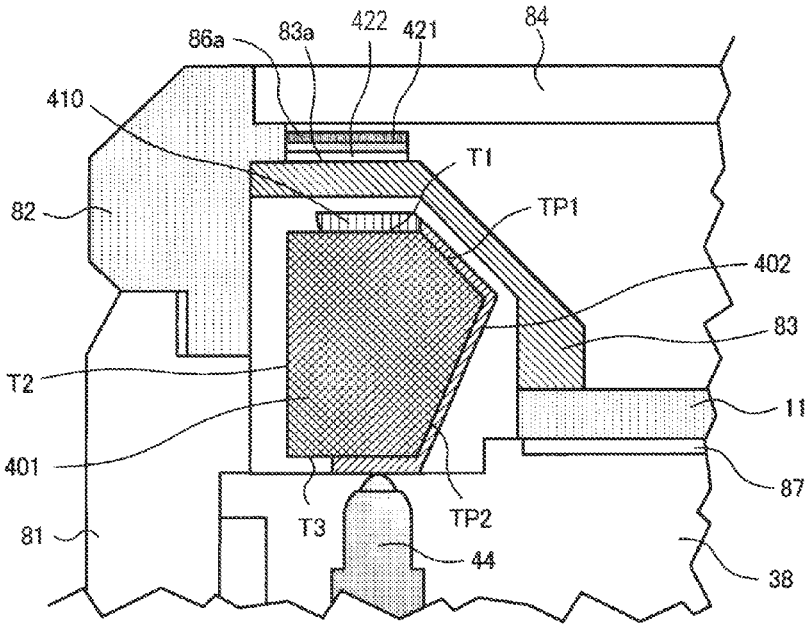
FIG. 7 is an enlarged section view of part of the internal structure of the electronic timepiece with internal antenna 200 (electronic timepiece 200) according to the second embodiment of the invention.

FIG. 6 is an exploded view of part of an electronic timepiece with internal antenna 200 (electronic timepiece 200) according to a second embodiment of the invention, and FIG. 7 is an enlarged section view of part of the internal structure of the electronic timepiece with internal antenna 200 (electronic timepiece 200) according to a second embodiment of the invention. The electronic timepiece 200 according to this embodiment of the invention differs from the electronic timepiece 100 in that the parasitic element is separate from the dial ring 83. Other aspects of this embodiment are the same as in the first embodiment, and further description thereof is omitted.

More specifically, as shown in FIG. 6, the parasitic element 421 is affixed to an annual flexible substrate 422 made of polyimide or other elastic material. In this embodiment the parasitic element 421 can be rendered as a copper foil pattern. The flexible substrate 422 is bonded to the top 83*a* of the dial ring 83 on the crystal 84 side. A blind 86*a* of plastic or other non-conductive material is disposed to the crystal 84 side surface of the parasitic element 421, and the blind 86*a* is bonded to the parasitic element 421 as shown in FIG. 7 [sic]. Note that a flat member stamped with a press from stainless steel could be used as the flexible substrate 422.

This electronic timepiece 200 achieves the same effect as the electronic timepiece 100 described above. In addition, because the parasitic element 421 and the dial ring 83 are formed separately, the characteristics of the antenna body 40 can be optimized by simply replacing the parasitic element 421 bonded to the flexible substrate 422 when, for example, the shape of the case 80 changes due to a change in the design of the electronic timepiece 200, and the tuning frequency of the antenna body 40 shifts due to the effect of the case 80. By discretely rendering the parasitic element 421 as described in this embodiment, a common antenna body 40 can be used in a variety of electronic timepiece 200 designs.

Figure 8:
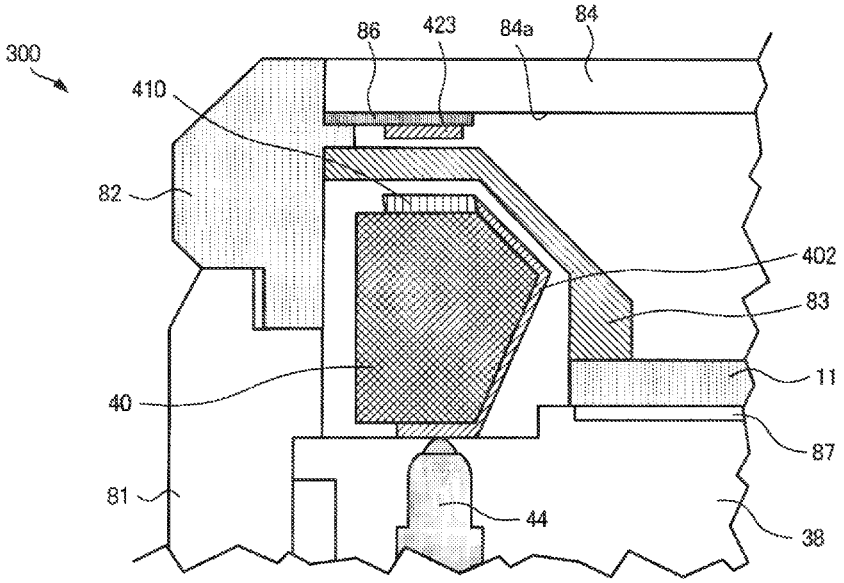
FIG. 8 is an enlarged section view of part of the internal structure of the electronic timepiece with internal antenna 300 (electronic timepiece 300) according to a third embodiment of the invention.

FIG. 8 is an enlarged section view of part of the internal structure of an electronic timepiece with internal antenna 300 (electronic timepiece 300) according to a third embodiment of the invention. The electronic timepiece 300 according to this embodiment of the invention differs from the electronic timepiece 100 described above in that the parasitic element is disposed on the ring antenna side of the crystal 84. Other aspects of this embodiment are the same as in the first embodiment, and further description thereof is omitted.

More specifically, as shown in FIG. 8, the parasitic element 423 is disposed to the back 84*a* on the dial ring 83 side of the crystal 84. In this configuration the parasitic element 423 is bonded to the crystal 84 through the blind 86.

This electronic timepiece 300 achieves the same effect as the electronic timepiece 100 described above. In addition, because the parasitic element 423 is not affixed to the dial ring 83, the characteristics of the antenna body 40 can be optimized by simply replacing the parasitic element 423 that is bonded to the crystal 84 that is replaced in conjunction with the change in the shape of the case 80 when, for example, the shape of the case 80 changes due to a change in the design of the electronic timepiece 300. By affixing the parasitic element 423 to the crystal 84 as described in this embodiment, a common antenna body 40 can be used in a variety of electronic timepiece 300 designs.

Embodiment 4

Figure 9:
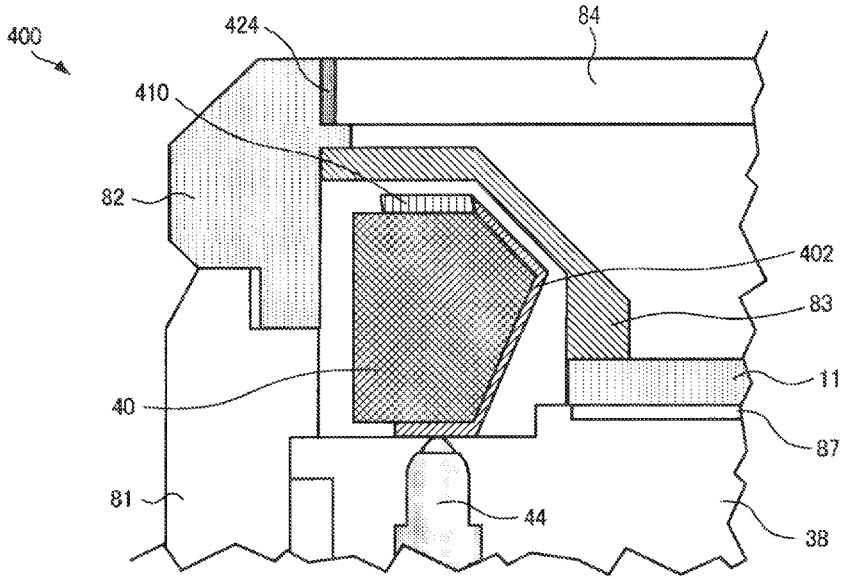
FIG. 9 is an enlarged section view of part of the internal structure of the electronic timepiece with internal antenna 400 (electronic timepiece 400) according to a fourth embodiment of the invention.

FIG. 9 is an enlarged section view of part of the internal structure of an electronic timepiece with internal antenna 400 (electronic timepiece 400) according to a fourth embodiment of the invention. The electronic timepiece 400 according to this embodiment of the invention differs from the electronic timepieces 100 to 300 described above in that the parasitic element is disposed between the crystal 84 and the bezel 82. Other aspects of this embodiment are the same as in the first to third embodiments, and further description thereof is omitted.

More specifically, as shown in FIG. 9, the parasitic element 424 is disposed between the crystal 84 and bezel 82, and the bezel 82 and crystal 84 are fit together with the parasitic element 424 therebetween. This configuration achieves the same effect as the electronic timepieces 100 to 300 described above. In addition, the blind 86 is eliminated, the parts count thereby reduced, and production can be simplified.

Other Examples

Preferred embodiments of the invention are described above, but the invention is not limited thereto and can be changed in many ways without departing from the scope of the accompanying claims. Variations such as described below can also be applied alone or combined in various ways.

For example, the fed element 410 is disposed to the top T1 of the antenna body 40 in the foregoing embodiments, but the invention is not so limited. The location of the fed element can be placed at any position where impedance can be adjusted according to the electromagnetic coupling with the parasitic element, including on the slope TP1.

The antenna is ring-shaped in the foregoing embodiments, but could be square or other type of annular shape. For example, a square annular antenna is desirable in a rectangular wristwatch having a digital information display unit disposed on the inside of the antenna.

The bezel 82 in the foregoing embodiments is made from a non-conductive material, but could be metal. By disposing the parasitic element 420 on the dial ring 83 as described in the invention, the influence of reception sensitivity is small and GPS satellite signals can also be desirably received. By using metal members, cost can also be reduced compared with a configuration using ceramic materials. In addition, because more parts are covered with metal, the effect of disposing the parasitic element between the dial ring and crystal on improving antenna characteristics is even greater.

As described above, when used to receive satellite signals from GPS satellites, the invention can more effectively reduce the size of the antenna body 40 while maintaining reception performance by using the parasitic element 420.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2013-031710, filed Feb. 21, 2013 is expressly incorporated by reference herein.

What is claimed is:

1. An electronic timepiece with internal antenna, comprising:

a tubular outside case of which at least part is made from a conductive material;

a cover member that covers one of two openings in the case;

a time display unit housed inside the case;

an annular antenna body disposed around the time display unit;

a feed part that feeds the antenna body; and a non-conductive ring member that covers the antenna;

wherein the antenna body includes an annular dielectric base and an arc-shaped fed element that is fed by the feed part, and an annular parasitic element is disposed between the ring member and the cover member, and receives circularly polarized waves.

2. The electronic timepiece with internal antenna described in claim 1, wherein:

the antenna body and the parasitic element are mutually superimposed in plan view.

3. The electronic timepiece with internal antenna described in claim 2, wherein:

the parasitic element is disposed on the cover member side of the ring member.

4. The electronic timepiece with internal antenna described in claim 2, wherein:

the parasitic element is affixed to an annular member, and the annular member is disposed to the cover member side of the ring member.

5. The electronic timepiece with internal antenna described in claim 1, wherein:

the fed element is disposed on the cover member side of the antenna body.

6. The electronic timepiece with internal antenna described in claim 1, wherein:

an annular blind member is disposed to the cover member so that the parasitic element is not visible from the outside.

7. The electronic timepiece with internal antenna described in claim 1, wherein:

an annular blind member is affixed to the cover member side of the parasitic element so that the parasitic element is not visible.

8. The electronic timepiece with internal antenna described in claim 1, further comprising:

a back cover made from a conductive material, the back cover being electrically connected to the outside case, and the back cover and the outside case functioning as the ground plane of the antenna body.

9. The electronic timepiece with internal antenna described in claim 1, wherein:

the outside case has a bezel that is made from a non-conductive material and fastens the cover member.

* * * * *